US005927440A

United States Patent [19]

Freeman

[11] Patent Number: 5,927,440

[45] Date of Patent: Jul. 27, 1999

[54] MOBILE HOIST SYSTEM AND METHOD

[76] Inventor: Glen D. Freeman, 3627 Beechway, Van Buren, Ark. 72956

[21] Appl. No.: 08/929,261

[22] Filed: Sep. 11, 1997

Related U.S. Application Data

[60] Provisional application No. 60/027,011, Sep. 11, 1996.

[51] Int. Cl.[6] ..... B66B 9/02

[52] U.S. Cl. ..... 187/270; 182/141

[58] Field of Search ..... 187/270, 255, 187/239, 240, 271; 182/14, 16, 141, 82

[56] References Cited

U.S. PATENT DOCUMENTS

| | | | |
|---|---|---|---|
| 76,693 | 4/1868 | Baldwin | 187/300 |
| 151,014 | 5/1874 | Fensom | 187/373 |
| 210,693 | 12/1878 | Hill | 187/352 |
| 394,781 | 12/1888 | Maurer | 182/229 |
| 1,032,320 | 7/1912 | Armstrong | 187/352 |
| 1,080,846 | 12/1913 | Phillips | 187/352 |
| 1,264,847 | 4/1918 | Otto | 187/352 |
| 1,931,237 | 10/1933 | O'Connell | 187/95 |
| 2,757,755 | 8/1956 | White, Jr. | 187/2 |
| 3,313,376 | 4/1967 | Holland, Sr. | 187/270 |
| 3,804,208 | 4/1974 | Iida | 187/19 |
| 3,866,717 | 2/1975 | Johansson | 187/19 |
| 3,866,718 | 2/1975 | Hiergeist | 187/27 |
| 3,924,710 | 12/1975 | Shohet | 187/19 |
| 4,516,663 | 5/1985 | D'Alessio et al. | 187/19 |
| 4,557,353 | 12/1985 | Pichon | 187/2 |
| 4,706,779 | 11/1987 | Bono | 182/63 |
| 4,865,155 | 9/1989 | Montaigne et al. | 187/239 |
| 5,065,845 | 11/1991 | Pearson | 187/89 |
| 5,312,218 | 5/1994 | Pratt et al. | 414/10 |

*Primary Examiner*—Kenneth Noland
*Attorney, Agent, or Firm*—Head, Johnson & Kachigian

[57] ABSTRACT

In accordance with one embodiment of the present invention, the mobile lift system includes a 3 ft.×3 ft. rack and pinion platform lift providing a cage able to lift at least one man and gear up a pole of a billboard sign or any advertising sign and to detach the platform from the rack so access can be achieved at many different pole/rack sites with a single platform lift. The mobile hoist or lift is practical because it eliminates ladders from tall poles and provides safer route access. This will save time for the worker because his harness has been eliminated and the hardship of climbing the ladders has also been eliminated. Another point of interest will be the saved money and reduced liability because the ladders have been removed so that unauthorized individuals cannot climb up the poles. Mobilizing the lift saves money in material cost and maintenance because there may be one platform for 150 racks (poles) or more. Another advantage over prior art is that there are no pins to insert or bolts to install when attaching or detaching the lift from the rack sites.

21 Claims, 9 Drawing Sheets

133
22
28
24
26
5
28
18
21
127
99
142
140
20
73
58
15
61
99
63
22
67
144
24
62
59
28
54
42
44
52
52
73
146
63
56
46
60
12
48
39
150
43
134
37
66
71
135
128
10
22
148
69
21
188
32
28
99
136
126
24
32
68
70
126
64
32

FIG. 4
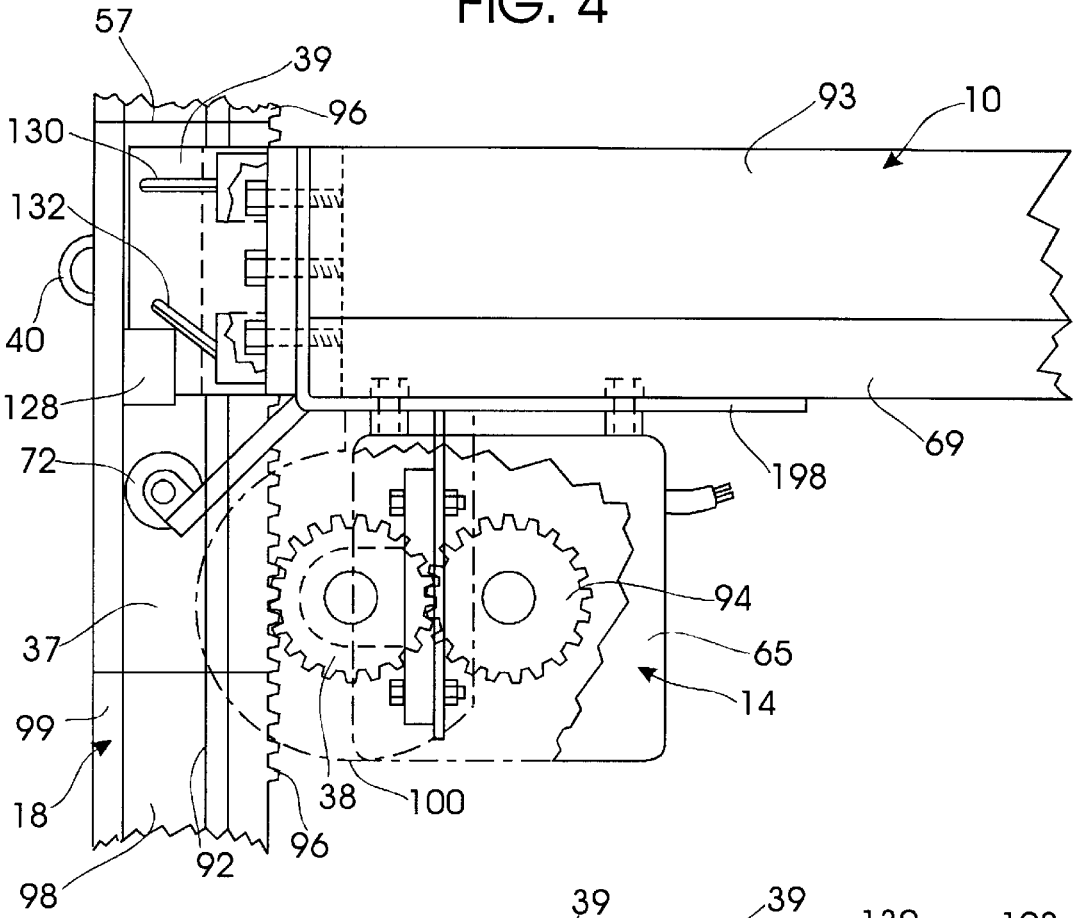
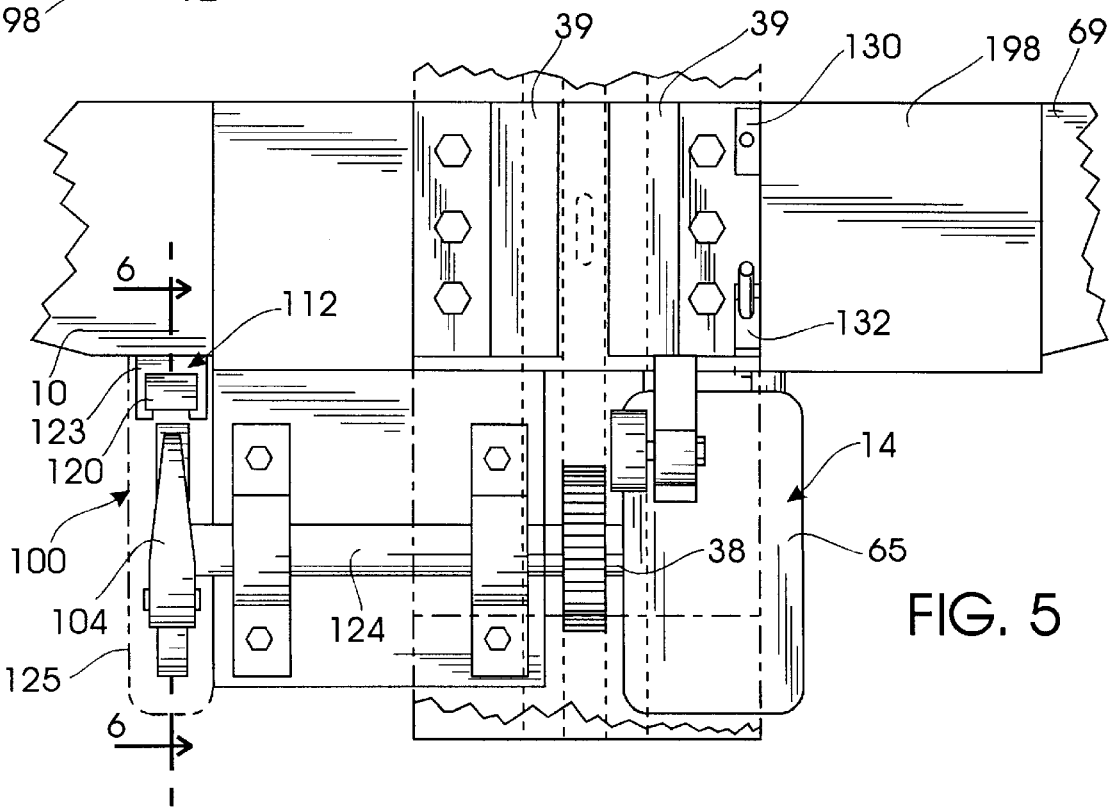
FIG. 5

200
202
204
206
208
210
212
214
218
220
222
224
230
232
234
236
238
240
242
244
246
250
252
254
262
264
266
268
282
284
286
288
308
310
312
314
316
318
320
328
330
332
342
344
346
350
364
368
370
372
374
376

MOBILE HOIST SYSTEM AND METHOD

CROSS-REFERENCE TO RELATED APPLICATIONS

This application is a continuation-in-part of provisional application Ser. No. 60/027,011, filed Sep. 11, 1996 and hereby incorporated by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

The present invention is directed to a mobile hoist system and method, components therefor, and/or units, assemblies, or subsystems thereof. More particularly, the present invention concerns an improved hoist, lift, or elevator system, components, assemblies, units, or subsystems thereof especially adapted for use in connection with billboards, signs, marquees, sign boards, displays, and the like.

In the construction industry or building industry, it is well known to use on-site erectable or portable elevators, hoists, cages, lifts, or the like for moving personnel and building materials up the side of a building under construction. Such known elevators, hoists, cages, lifts, or the like have suffered from the drawbacks of being extremely complex, difficult to set up on-site, difficult to maintain, difficult to disassemble or take down, unsafe, difficult to operate, and the like.

Holland (U.S Pat. No. 3,313,376) discloses a lightweight elevator which in one configuration includes an L-shaped track member, a gear rack attached to the track member and adapted to receive a pinion gear at the free end of the output shaft of a motor attached to a platform. The motor is controlled from the ground by a suitable switch means through a current lead.

Pearson (U.S. Pat. No. 5,065,845) discloses a speed governor safety device for stopping an elevator car.

Johansson (U.S. Pat. No. 3,866,717) discloses a rack and pinion elevator with at least two racks, a plurality of drive motors, and a speed safety brake.

U.S. Pat. Nos. 151,014; 1,080,846; 1,032,320; 1,264,847; 210,693; and 76,693 disclose elevator safety devices.

Pichon (U.S. Pat. No. 4,557,353) discloses a service elevator for construction.

O'Connell (U.S. Pat. No. 1,931,237) discloses an elevator guide including a dovetail or wedge-shaped track.

Maurer (U.S. Pat. No. 394,781) discloses a convertible scaffold and fire escape including uprights having a T-shaped head on the front face thereof and having a racked front face adapted to engage a pinion gear.

D'Alessio et al. (U.S. Pat. No. 4,516,663) discloses a safety device for a rack and pinion hoist including a frangible rack section of reduced dimensions adapted to disintegrate and thereby disengage the rack in case of malfunction.

Shohet (U.S. Pat. No. 3,924,710) and Iida (U.S. Pat. No. 3,804,208) disclose rack and pinion hoist apparatus.

White (U.S. Pat. No. 2,757,755) discloses a portable elevator.

Bono (U.S. Pat. No. 4,706,779) discloses a transportable twin-telescopic arm platform hoist including a twin-arm telescopic unit, a carriage with a work platform mounted on the twin-arm unit, and a self-propelled or towed vehicle supporting the twin-arm unit on a pivoting platform.

Hiergeist (U.S. Pat. No. 3,866,718) discloses a reeling device for load and safety ropes or cables on suspended outdoor elevator-type cages and having a single reeling drum on which the load and safety ropes or cables are wound.

Pratt (U.S. Pat. No. 5,312,218) discloses a folding apparatus for positioning objects into structures.

Montaigne et al. (U.S. Pat. No. 4,865,155) discloses a high-rise fire fighting and rescue system including an external elevator system which piggybacks a first rail car on top of a second rail car to permit transfer of the first rail car to an upper setback section of a high-rise building. Each rail car is equipped with pinion drives that engage racks fixed to vertical rails attached to faces of the building. The cars also have motor driven wheels that allow the car to drive on horizontal surfaces.

Hence, there exists a need for an improved mobile hoist system and method incorporating at least a transportable or movable cage, lift, or platform, and which is relatively simple in construction, safe, and easy to use.

BRIEF SUMMARY OF THE INVENTION

In accordance with the present invention, a mobile hoist system and method is provided which addresses the drawbacks of the prior art and which is relatively simple in construction, safe, easy to operate, and easy to maintain. In accordance with a preferred embodiment of the present invention, the mobile hoist system and method is especially adapted for use in connection with billboards, highway or road side signs, marquees, sign boards, displays, ad signs, and the like and, more particularly, for getting people and supplies up to the sign for replacing letters or advertising, servicing lights, changing advertising by painting, papering or vinyling, or otherwise maintaining the billboard or sign.

Across the United States and around the world, there are numerous billboards, signs, marquees, and the like which require regular maintenance, advertisement updating or changing, or servicing which entails one or more persons climbing up a ladder on a pole or sign support to a service platform and carrying with them or hoisting up later tools, equipment, signs, and the like to the platform. After the work is done on the sign, they must climb back down the ladder.

In accordance with the present invention, the climbing of ladders and the ladders themselves is supplemented or eliminated by the use of an elevator, cage, hoist, lift, platform, carriage, or the like which is transported to the job site and which is adapted to ascend and descend the pole by way of a rack and pinion, cable, or other drive system. In accordance with the preferred embodiment, the elevator, lift, hoist, cage, platform, or the like is self-propelled and adapted to be releasably attached to a rack or cable on the pole. In this fashion, a practical, effective, and relatively inexpensive billboard or sign maintenance or servicing system is provided which requires the attachment of a rack or cable to at least one pole on each sign or billboard, and use of a single transportable or mobile lift, cage and/or platform to and from each job site or sign.

In accordance with one embodiment of the present invention, a cage and platform are transported to the job site in the back or on the bed of a truck, the truck is backed up to a pole having a vertically oriented gear rack fixed to the pole, the cage and platform are slid on two tracks to the pole with a gear plate extending into an opening in the gear rack, a locking lever on the platform is moved to a safety locking position, then the platform motor is operated to move the cage up and down the pole. A free-fall preventer is attached to the platform to limit free-fall by having a strike pawl swing outwardly from a rotating disc under centrifugal force and lock with a catch. The strike pawls are biased inwardly by a spring or magnet.

In one example, the mobile lift is a 3 ft.×3 ft. rack and pinion platform lift providing a cage and platform able to lift one man and gear up and down a pole of a billboard sign or any advertising sign and to detach the platform from the rack so maintenance, servicing or other access can be achieved at many different pole/rack sites (signs) with a single platform, truck and servicing person.

The mobile platform lift is practical because it eliminates ladders from tall poles and provides safer route access. This system will also save time for the worker because his ladder climbing harness and the hardship of climbing ladders has been eliminated.

Another point of interest is the money savings and reduced liability because sign ladders have been removed so that unauthorized individuals cannot climb up the poles.

Mobilizing the lift saves money in material cost and maintenance because there may be one mobile platform for 150 racks (signs) or more. Imagine the cost of 150 platforms each with a cage, drive motor, reducer and the maintenance that follows, opposed to one platform.

Another advantage over prior art is that there are no pins to insert or bolts to install when attaching or detaching the present lift to or from each rack site.

In accordance with another embodiment of the present invention, a cage and platform are transported to the job site on a launching pad at the end of an extendable arm in the bed or on the back of a truck, the truck is backed up to a position near a pole having drive and safety cables attached to the pole, the cage and platform are placed adjacent the pole by extending the arm or boom, the drive and safety mechanism of the cage and platform are engaged with the cables, and the platform motor is operated to move the cage up and down the pole. A free-fall preventer and safety cable is attached to the platform to limit free-fall should there be a problem with the drive cable.

The principle object of the present invention is the provision of a hoist system and method involving a hoist which is relatively simple in construction, easy to install, safe, easy to operate, and easy to maintain.

Another object of the present invention is the provision of an improved mobile hoist and method including a transportable lift, platform, or cage.

A further object of the present invention is the provision of an improved drive system for a mobile hoist.

Yet another object of the present invention is the provision of an improved free-fall preventer.

Still yet another object of th e present invention is the provision of an improved drive and safety cable arrangement.

Yet another more particular object of the present invention is an improved rack and pinion drive system.

Another object of the present invention is the provision of a self-contained, self-propelled, transportable mobile hoist cage and platform.

Other objects and further scope of the applicability of the present invention will become apparent from the detailed description to follow, taken in conjunction with accompanying drawings wherein like parts are designated by like reference numerals.

BRIEF DESCRIPTION OF THE SEVERAL VIEWS OF THE DRAWINGS

FIG. 4 is an enlarged fragmentary side view representation of the platform of FIG. 1 operatively engaged with the rack.

FIG. 5 is a front elevational view representation of the drive arrangement of FIG. 4.

DETAILED DESCRIPTION OF THE INVENTION

Figure 1:
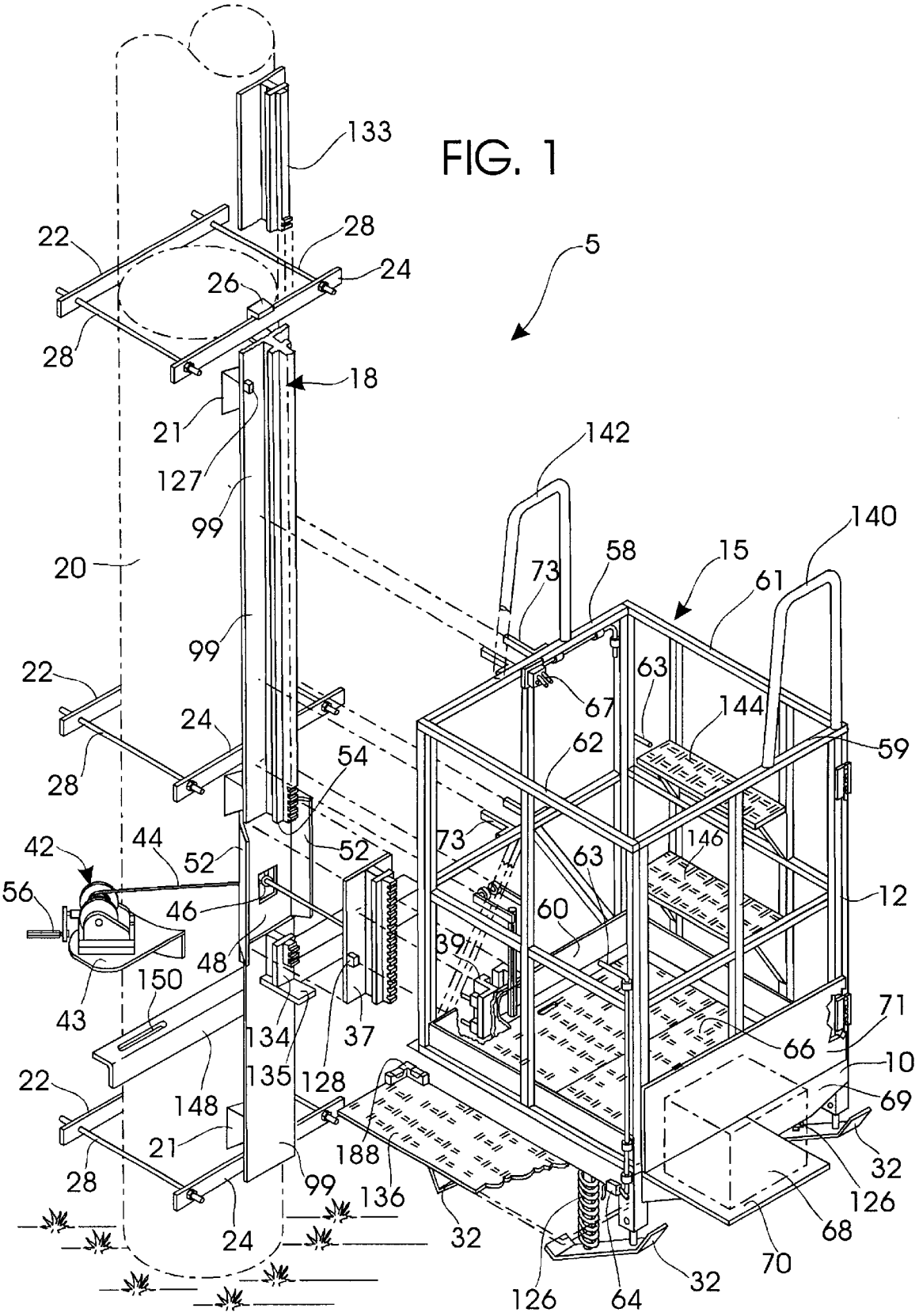
FIG. 1 is a perspective view illustration of a mobile hoist system in accordance with one embodiment of the present invention.

In accordance with an exemplary embodiment of the present invention as shown in FIGS. 1–17 of the drawings, a rack and pinion mobile lift system generally designated 5 includes a deployable, transportable platform 10 with a cage 12, and motor unit 14 for lifting at least one man with gear (supplies) or at least about 300 lbs. The platform, cage and motor unit 10, 12 and 14 together form a self-propelled lift or elevator 15 which is capable of being moved to several different locations by hauling the lift 15 in or on the bed of a pickup, utility or flatbed truck 16. At each location there is preferably a rack 18 affixed to a pole 20 by metal supports 21 welded to a metal pole or brackets including plates 22 and 24 and rods 28. Plates 22 are placed in the back of a wooden or metal pole with one hole drilled in each end of the plates 22 and plates 24 are located in the front of the pole and threaded through respective loop elements 26 attached to the rack 18 with a hole drilled in each end of the plates 24. Respective pairs of plates 22 and 24 are spaced, for example, at 5-ft. vertical intervals. Threaded bolts or rods 28 are placed through the holes of each of the plates 22 and 24 and nuts are employed on the ends of the bolts 28 for tightening the plates 22 and 24 to the pole 20 by drawing tension to the ends of the plates 22 and 24. Thus, creating holding pressure to the pole 20 sufficient to support rack 18 and lift 15.

Figure 2:
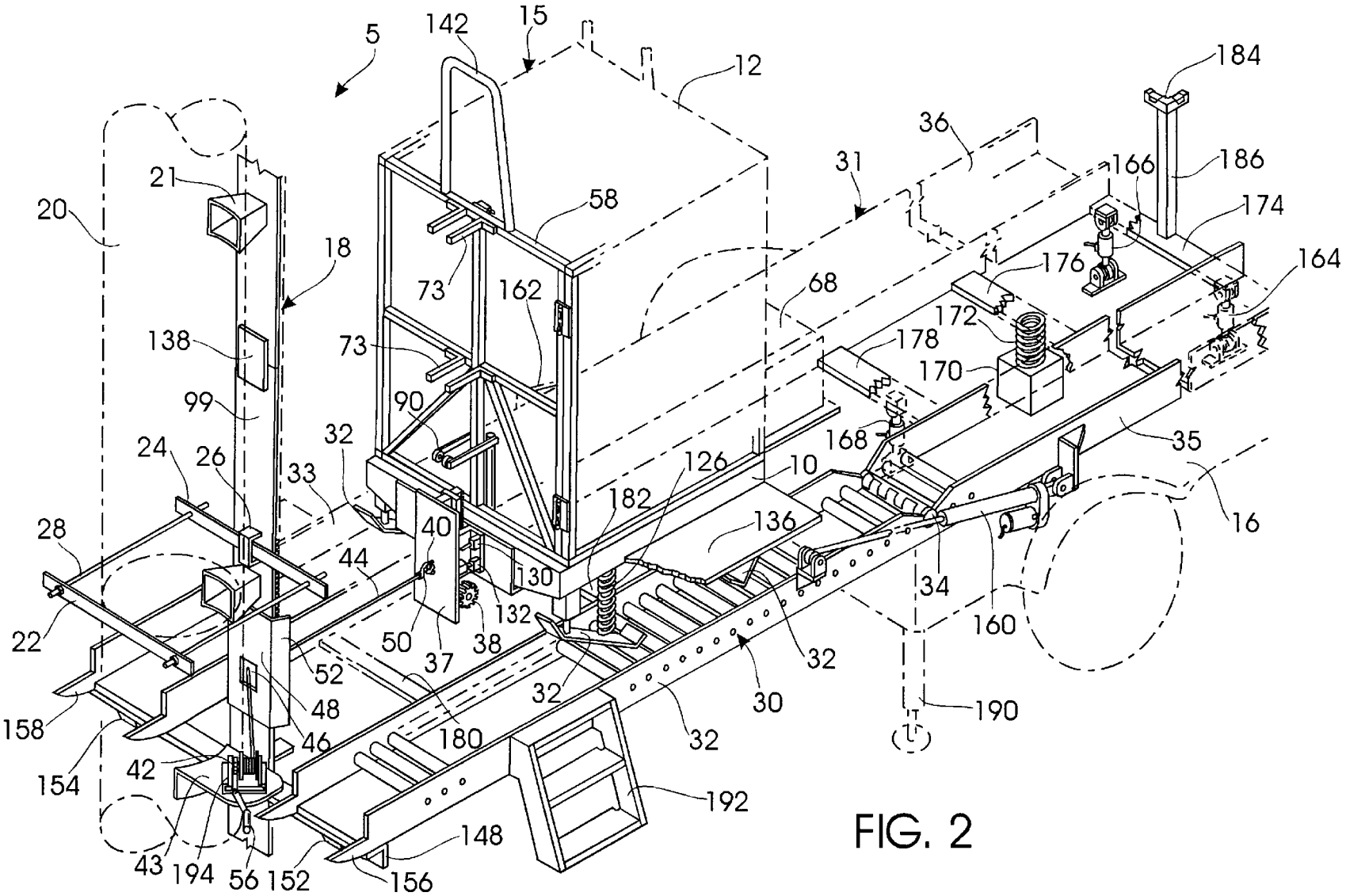
FIG. 2 is a perspective view representation of the mobile hoist system of FIG. 1 being deployed from the bed of a truck.

As shown in FIG. 2, the lift 15 will be transported from the bed of the truck 16 to the rack 18 on pole 20 via two rollerbed conveyors 30 and 31. One conveyor for each side of the lift 15 to support respective skidplates or skids 32 mounted to each corner of the platform 10. The skidplates 32 glide across the idler rollers of the conveyors 30 and 31 for easy transport to the rack 18 or truck 16. The conveyors 30 and 31 include extending portions 32 and 33 which are placed at the base of the rack 18 via male and female jointing or hinges 34 located at the junction with cradle sections 35 and 36 located inside the bed of the truck 16.

The platform 10 is releasably attached to the bottom of the rack 18 by a gearing plate 37 which is about 12 to 18 inches and is positioned onto the platform 10 via the guide brackets 39. The gearing plate 37 is held in position by a first or safety 4-inch pinion gear 38, which is meshed into the teeth of the gearing plate 34. On the side opposite of the gearing teeth or the backside of the gearing plate 37, is a loop 40. A winch 42 located on a support plate 43 on the pole 20 has a pulling a cable 44 which passes from the winch drum or spool through an eyeguide 46 and then through a window plate 48. The eyeguide 46 and window plate 48 allow the cable 44 to pass through a gap in the rack 18 and to the loop 40 on the back of the gearing plate 37. On the free end of cable 44 is a grab hook 50. Forwardly angled walls or guides 52 on the window plate, the winch cable 44, and the sides of the rollerbeds 30 and 31 guide the platform 10 toward the center of the rollerbeds 30 and 31 and also guide the gearing plate 37 horizontally in line with a rack gap or cavity 54 dimensioned to receive the gearing plate 37.

If a person or system operator attaches hook 50 to loop 40 (FIG. 2), turns a handle 56 of the winch 42 in a direction to gather up the cable 44 onto the spool of the winch 42, the cable 44 becomes shorter, thus moving or pulling the platform 10 closer to the rack 18. When the length of the cable 44 shortens and has pulled the platform 10 and gearing plate 37 to the point the plate 37 contacts guides 52 of the plate 48, tension from the cable 44 as it is further tightened, securely holds the gearing plate 37 into the cavity 54 and in line with the rack 18. As is conventional with winches, winch 42 includes a spool or drum stop or brake which will prevent the cable 44 from paying out while the gearing plate 37 is in its operative position in rack 18.

The operator, instead of using the winch 42 for tightening purposes, may use a turnbuckle or other releasable tightening device for holding gearing plate 37 in position. For example, a turnbuckle having hooks, one on each end, can be used. One hook will thread through the loop 40 on plate 37 and the other through an eyebolt mounted to the pole. The operator can rotate the turnbuckle until it tightens the gearing plate to the cavity of the rack.

When the top of the guide brackets 39 (as you descend) pass below a top seam 57 of the gearing plate 37 and rack cavity 54 by about 1 inch, the detaching position is achieved (FIG. 4). Then, the operator can release tension from the cable 44 that holds the gearing plate 37 in position in the cavity 54 of the rack 18. The gearing plate 37 will release from the rack 18, thus, releasing the platform 10. Then the platform 10 (lift 15) can be rolled onto the cradle 35 and 36 in the bed of the truck 16.

The Cage

The cage 12 includes front and rear guard railing 58 and 59 which borders the front and rear sides of the 3 ft.×3 ft. platform 10 and is made of 1-inch square steel tubing with ⅜ inch thickness. The rails 58 and 59 will be about 3 ft. wide×4 ft. tall, for each of the sections, with a 4-inch kickplate 60 located at their base. Right and left side sections 61 and 62 serve as doors and each have hinges on one side and a handle 63 with locking device on the side opposite the hinges. A safety switch 64 below each handle 63 will enable power to motor 65 of motor unit 14 when the doors 61 and 62 are closed. The platform 10 includes a floor surface 66 of gridstruck to prevent slippage in wet conditions. These features will provide a safe environment for the worker on the platform during operation.

A drive enable control 67 for ascend and descend is mounted inside the cage 12 on the inside of the guard railing 58. This control 67 and all electrical controls, switches, and conduit should be sealed to prevent moisture from penetrating these components. The lift 15 is powered by a generator 68 located outside the guardrails, but affixed to subframe 69 of platform 10 on a plate 70 in the back of the lift 15. A fire guard or plate 71 is located between generator 68 and cage 12. The generator 68 should have a ground fault device so that when a short circuit occurs, the power should be immediately shut off. This will also protect the operator in the cage.

Cage Stabilizers

To ensure the prevention of unwanted damage to the drive components, there is a foot 72 located at the base of the subframe 69 and two fixed cage stabilizers 73 are mounted on the guard rail 58. These will stabilize the platform so unwanted stress will not occur when the load shifts during operation. The foot 72 will prevent the platform from a downward pull when the load is toward the backside of the lift 15. The two stabilizers 73 are located near the center and the top of the guard rail 58 to be useful in an emergency situation if, for example, the guide brackets 39 break. This will prevent the cage 12 from tipping forward. The foot 72 and stabilizers 73 also work as part of a secondary guide system.

Secondary Guide System

Figure 3:
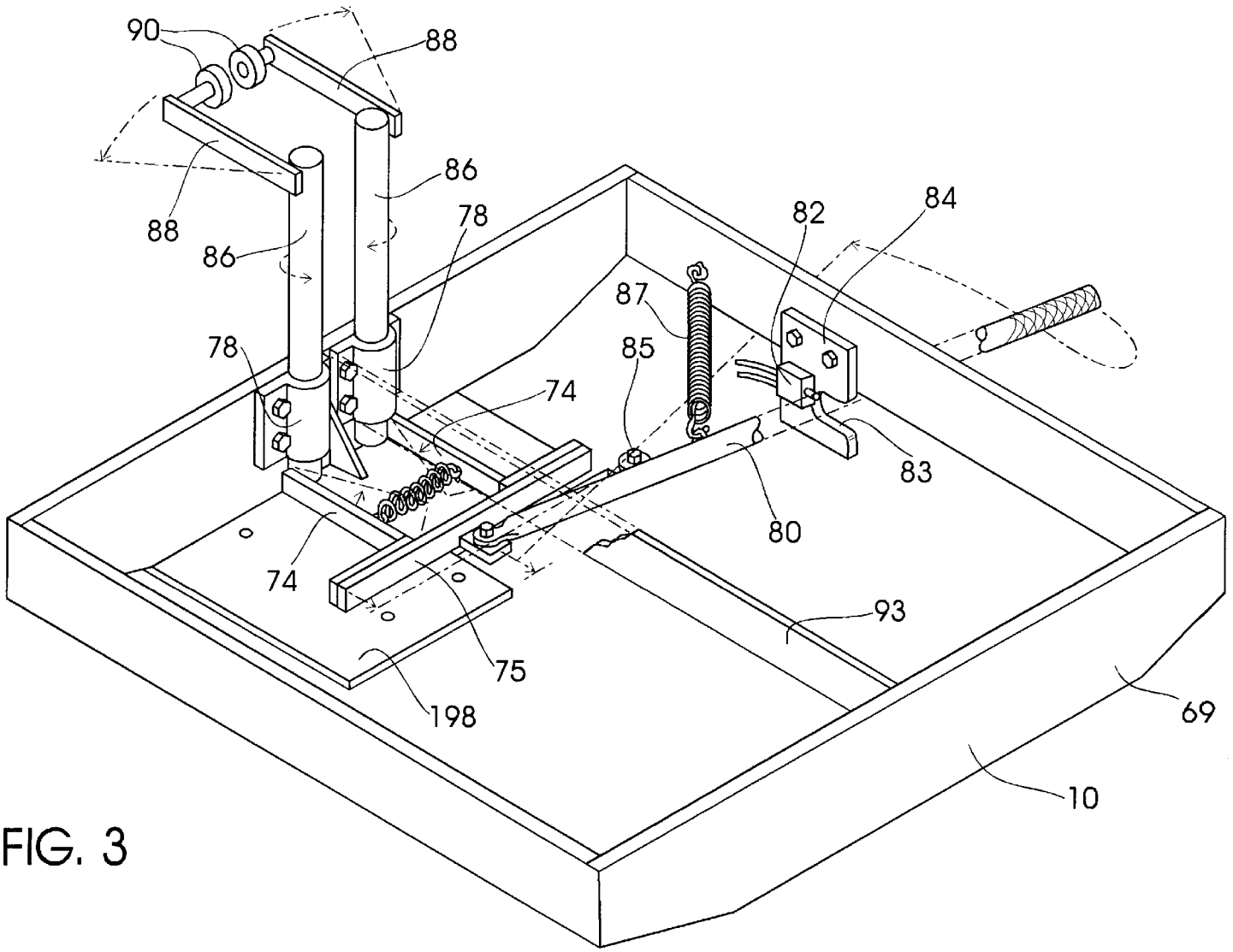
FIG. 3 is a perspective view illustration of the platform of the lift of the mobile hoist system of FIGS. 1 and 2.
Figure 7:
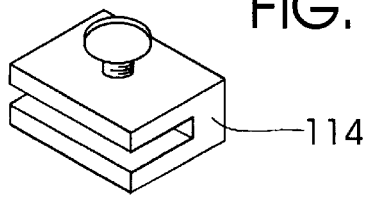
FIG. 7 is a perspective view illustration of one of the counterweights of the free-fall preventer of FIG. 6.

The mobile lift preferably has a secondary guide system in the event the guide brackets 39 break or fail to work properly. The secondary guide system will prevent the platform 10 from tipping or disengaging the rack 18 in an emergency situation. As shown in FIG. 3, the secondary guide system includes two guide arms 74, a wall plate 75, two ball bushings, two pillow block bearings 78, an engagement arm 80, and a safety switch 82.

Engagement of the secondary guide system occurs when the engagement arm 80 is pulled into a locking cavity 83 of a plate 84 attached to the platform subframe 69. When the engagement arm 80 is pulled, it pivots about a bolt or pin 85 with the bias of a return spring 87 and force is transmitted from the wall plate 75 to the guide arms 74. When this occurs, the guide arms 74 shift with bias toward the ends of the wall plate face. This will result in simultaneous opposite rotation of vertical guide arm shafts 86 attached to the guide arms 74, the arm shaft (motor side) rotating left to right and the arm shaft on safety disc side rotating right to left. This, in turn, swings extension arms 88 having guide wheels 90 to a rack engaging position behind a gearing plate base 92 of the rack 18.

As shown in FIG. 3 of the drawings, the engagement arm 80 is shown in a position engaging safety switch 82 and thereby allowing the motor 65 to be activated and drive the platform and cage up and down the rack. In this position, the guide wheels 90 are engaged with the rack 18 to provide a secondary or safety guiding system. If the lift operator leaves the engagement arm 80 in a non-engagement position out of locking cavity 83, then safety switch 82 is not activated and the motor unit and drive motor cannot be activated.

The floor 66 of lift 15 is constructed of two or more gridstruck plates which rest on a cross-brace 93 of platform 10 and include one or more handles for selectively raising the plates to access the motor unit, secondary guide system, and the like. In a particular application, the platform 10 can be enhanced to include additional cross-braces and bracing members to provide a lift which can support two or more workers and their gear without twisting or bending of the platform and cage.

Rack and Pinion Mobile Lift Drive System

The rack and pinion mobile lift 5 uses the rack 18 and pinion 38 for ascending and descending the pole 20. In accordance with a preferred embodiment and as shown in FIGS. 4 and 5, a second 4-inch drive pinion 94 is rotated by a 1 HP electric motor 65 at 1750 RPM with a 58 RPM reducer and meshes with the gearing teeth of the 4-inch safety drive pinion 38. The safety drive pinion 38 then, during rotation, will transmit force to gearing teeth 96 of the rack 18. When the second drive pinion 94 rotates clockwise, the safety drive pinion 38 rotates counter-clockwise (FIG. 4). Thus, the platform 10 will climb the rack 18 at approximately 1 ft. per second. When the second drive pinion 94 rotates counter-clockwise, this will force the safety drive pinion 38 in a clockwise rotation (FIG. 4). Thus, the platform 10 descends at the 58 RPM down the rack 18. The motor 65 of lift 15 is preferably a brake motor or the motor unit 14 includes a motor brake for accurate positioning when the desired stopping location is reached. Lift controls 67 are used to activate the motor 65 to climb or descend the rack and pole 20. There is a guide channel 98 on each side of the rack 18 directly behind the gearing plate base 92 and in front of a backing plate 99. The channel 98 is preferably about ¾-inch in width and 2 inches in depth, this will provide the means by which the guide brackets 39 will travel up and down the rack 18. The guide brackets 39, which are rigidly mounted to the platform subframe 69, slide along the guide channels 98 of the rack 18 in a vertical position. The guides 39 force the platform 10 to stay consistent in exact distance, parallel with the rack 18. This results in the safety drive pinion 38 meshing with the teeth 96 of the rack 18 over the length of the rack. The gearing plate 37 is identical in construction to a section of rack 18 and includes a gearing plate, rack teeth, gearing plate base, guide channels, and a backing plate.

The Safety Disc

Figure 6:
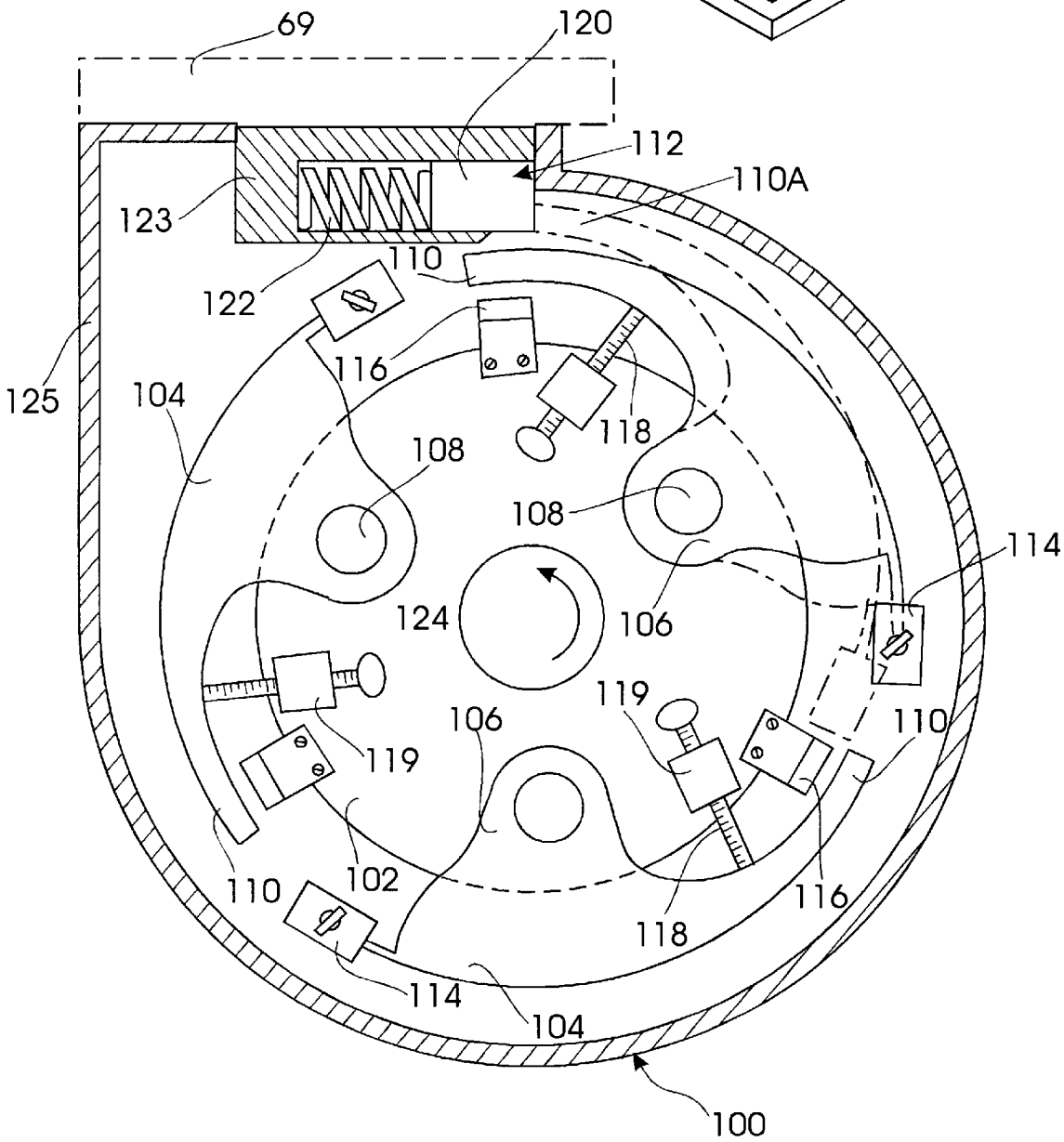
FIG. 6 is a partial cross-sectional illustration of the free-fall preventer or safety stop mechanism of FIG. 5.

With reference to FIGS. 4, 5 and 6 of the drawings, the lift 15 is equipped with a safety stop or device 100 that will catch the platform 10 in case free-fall occurs or if overspeed develops during descent. The safety device or free-fall preventer 100 works by centrifugal force and in one embodiment includes a disc 102 of 6-inch diameter having three striking pawls 104, one in equal distance from the other around the outer edge of the disc 102. On each pawl 104 there is a pivoting end 106 attached to the disc 102 by a bearing 108. Also, on each pawl 104 there is a striking end 110 which is adapted to strike a catching or stop block 120 of a pawl catch 112. A counterweight 114 with enough weight to force the striking end 110 into the up position (striking mode) 110A is located opposite the striking end 110 of each pawl. A magnet 116 is attached to the disc 102 in a manner to be positioned directly underneath the striking end 110 of each pawl 104. The magnet 116 will create downward pull on the striking ends 110. A set screw 118 is affixed to the disc 102 by a support 119 to make contact with the striking side 110 of each pawl. When the set screw is turned, the striking side of the pawl will either move up or down, depending on the direction the screw is turned.

The concept on which each of the pawls 104 work is by countering the pull of the counterweight 114 with the magnet 116 creating balance of the pawl. The set screw 118 fine tunes the sensitivity of the striking end 110 of each pawl to centrifugal force. This will determine how much centrifugal force will be required to trigger the striking end 110 of each pawl to move into the up or out position 110A to contact the pawl catch 112. When the striking end is in the up position, as it rotates around the disc, it will eventually strike a stop block 120 of the pawl catch 112. Force against the stop block 120 compresses a cushion stop spring 122. When the spring is fully compressed, the disc 102 and platform 10 will completely stop. The compression spring 122 is designed to prevent a sudden stop of the platform 10. This cushions the stop for the operator and decreases the chance of breaking a component of the safety disc 100 and the lift system 5.

The pawl catch 112 also includes a switch or sensor which senses compression of spring 122 and movement of stop block 120 in a support channel 123 to deactivate the motor should the safety device 100 be activated by free-fall or overspeed descent of the lift 15.

Disc 102 of safety device 100 is supported on a shaft 124 which also supports safety drive pinion 38 on an opposite end thereof. Hence, disc 102 rotates along with drive pinion 38. Channel 123 of pawl catch 112 is securely attached to subframe 69 of platform 10. The operative components of safety device 100 are located within a protective and tamper resistant housing 125 which is attached to subframe 69 of platform 10. The housing 125 prevents an operator from readjusting the tripping velocity of the pawls 104 by manipulating the counterweights 114 or set screws 118. It is preferred that the safety device 100 be preset at the factory and only maintained and/or adjusted by a qualified professional.

With respect to FIG. 6 of the drawings, the pawls 104 of safety device 100 are only able to operatively contact the front face of stop block 120 of pawl catch 112 when the disc 102 is rotating at a high velocity in a counter-clockwise direction. When the disc 102 is rotating in a clockwise direction, pawls 104 move past pawl catch 112 and although they may rub against it at a high velocity of ascent of lift 15, they are not in an operative position to stop movement of disc 102 or shaft 124. In order to reset the safety device after a stop condition has occurred, one simply drives the motor 65 in the direction for climbing or ascent of the lift 15 to move the pawl 104 away from stop block 120 of pawl catch 112 and then the lift 15 is free to be moved up or down the rack 18.

Lift Suspension System and Ascend and Descend Safety

The lift 15 has a suspension system designed for smooth operation during landing. When the lift reaches touchdown or when contact is made between the skidplates 32 and the rollerbeds 30 and 31, suspension springs 126 on each of the skids 32 compress. When the skidplates touch the rollerbeds and the springs 126 compress, a shut off switch will activate, thus, stopping all drive components and engaging the motor brake. There are switch enable ears 127 and 128 on the rack 18 to activate two microswitches 130 and 132 mounted to the subframe 69 of the lift 15. Limit switch 130 contacts ear 127 and shuts off power to the motor when the lift reaches the highest position desired on the rack and the limit switch 132 contacts ear 128 and shuts off power to the motor when the lift is in position for landing (FIG. 4).

Note that one important safety factor on the rack is that the gearing teeth 96 do not go all the way to the top or the bottom of the rack 18. If the upper limit switch fails, the gearing for which the drive components use to enable the platform to climb is eliminated at 133 so the lift cannot climb over the top of the rack. The channel guides 98 are at least 18 inches longer than the gearing teeth 96 and continue to hold the lift in place on the rack in this situation. During the landing, if the lower limit switch fails, there is a threshold of distance the suspension springs 126 provide, the gearing is eliminated at 134, and a stop plate 135 is added at the bottom of the rack 18 to prevent damage to the drive components. If the system were based on a sudden stop, there would be no room for the energy the drive components produce to be absorbed, thus damage could occur. Therefore, the energy is absorbed between the platform and the skid-plates instead of the drive shaft and pinions, and gearing teeth of the rack. As an added precaution, this will also give a circuit breaker in the motor drive circuit a sufficient amount of time to kick off the electric to the motor. It will gradually reach its full load capacity instead of all at once. The suspension springs 126 are a practical part of a completely effective system.

Exemplary Parts List for Rack & Pinion Mobile Lift System

Wallplate
Eyeguide
Pillow Block Bearings
Guide Arm Plates
Safety Engagement Arm
Safety Arm Holder With Safety Cavity
(2) Bracket Guides
(4) Ball Bushings
(4) Shut-Off Limit Switches
(2) Guide Arms
(2) Guide Arm Shafts
Subframe
4-inch Safety Drive Pinion
4-inch Drive Pinion
1¼ inch Shaft (Safety Drive Pinion)
Gearbox Reducer, 1750 input, 58 output, 30/1
Motor, 1 HP at 1750 RPM
(3) Striking Pawl
(3) Pawl Bearings
(3) Magnets With Holders
Sensitivity or Bias Set Screw With Holder
Striking Plate
Stop Cushion Spring
Final Stop Plate
Pawl Catch
Disc Housing
Safety Disc Subframe
Rack
Gearing Base
Back Plate
Seam Plate
Window Plate
Gearing Plate
Winch
Turnbuckle
Grab Hook
Winch Mount
Cradle
(2) Rollerbeds
Loop Plate
Rack Installation Plates
All Threaded Bolts
Drive Enable Control
Relays
Guard Rails
(4) Suspension Springs
(4) Skidplates
Skidplate Mounts
Door Locking Device
Foot
Platform Stabilizers A step plate or stepper 136 is added to one or both sides of the platform 10 to assist the operator in entering or leaving the cage 12 or to provide a void between the platform 10 and a catwalk to prevent the operator from having his toes injured by being pinched between the platform 10 and the catwalk (FIGS. 1 and 2).

The gearing plate 37, window plate 48 and rack gap 54 may be modified to be about 3 or 4 ft. in length rather than 1 or 2 ft. Also, an upper set of guide brackets 39 may be added to the railing 58 of cage 12. Addition of upper guide brackets 39 increases the stabistability of the lift. Lengthening of the gearing plate 37 reduces the overall cost of the system since each of the racks on the poles will have three or four feet less of rack 18 and can be constructed at less cost.

In accordance with a preferred embodiment of the present invention, the gearing plate 37 is transported with the transportable lift 15 (FIG. 2) to and from the job site. This leaves the rack gap 54 vacant between maintenance or service calls on, for example, a billboard or sign atop pole 20 so that unauthorized persons do not have access up the pole 20. Although it is preferred to have the removable gearing plate 37, it is contemplated that one may use the transportable lift 15 with a gearing rack which is continuous and does not include a rack gap 54 and a gearing plate 37 but that accomodation would have to be made for moving the guide brackets 39 outwardly and inwardly so that they can engage the guide channels of the rack. For example, converting the guide brackets 39 to movable guide elements such as the guide rollers 90 (FIG. 3).

Also, although it is preferred to use the winch 42 and winch cable 44 for positioning and holding the gearing plate 37 in its operative position in gap 54 of rack 18, it is to be understood that other elements such as turn buckles, actuators, drawdowns, and the like may be used.

Further, rack 18 is preferably formed of rack sections joined by plates 138 to reduce the cost of manufacture and facilitate the construction of selected rack lengths depending on the particular job site and pole length. Although both rack supporting elements 21 and brackets or clamps including plates 22, 24 and rods 28 are shown mount in the rack 18 to pole 20, it is to be understood that if, for example, pole 20 is formed of metal, that supports 21 may be welded thereto and the brackets or clamp made of the plates 22, 24 and rods 28 may be eliminated. Also, it is contemplated that the rack 18 may be erected on site to a pole using the brackets including plates 22, 24 and rods 28, supports 21, and plates 138 without the use of welding equipment should there be a necessity to do so.

With reference again to FIGS. 1 and 2 of the drawings, lift 15 includes grab handles 140 and 142 and steps 144 and 146 to provide the operator with the means for climbing out and over railing door 61 in order to access a landing located near the top of door 61 rather than adjacent the floor 66 of platform 10.

As shown in FIGS. 1 and 2 of the drawings, a rollerbed anchor or brace member 148 is attached to the backing plate 99 of rack 18 transverse to the rack and includes an elongate slot 150 in each side thereof. The brace 148 is adapted to receive the free ends of rollerbed sections 32 and 33 and to support the rollerbeds in the proper position with respect to the rack 18 and pole 20. Additionally, V-shaped protrusions 152 and 154 extend downwardly from the free ends of roller bed sections 32 and 33 and are dimensions to be received within the elongate slots 150 in each side of brace 148. Additionally, curved guide surfaces 156 and 158 extend from each of the rollerbeds 30 and 31 to facilitate in the alignment and guiding of the rollerbeds and protrusions 152 and 154 with respect to the brace 148 and slots 150.

Extending sections 32 and 33 of rollerbeds 30 and 31 are raised and lowered by side actuators 160 and 162. When the lift 15 is being transported to a job site, the lift 15 is located up on the cradle of rollerbed sections 35 and 36 and the extending roller sections 32 and 33 are raised by contracting the actuators 160 and 162 sufficiently not only to lift the roller sections 32 and 33 vertical, but continuing on to angle them forwardly and reduce the overall height of the components being transported. The cradle including rollerbed sections 35 and 36 is adjustable to level the rollerbeds 30 and 31 at a particular job site and facilitat the proper positioning of the rollerbeds with respect to the brace 148 and facilitate the movement of the lift 15 along the rollerbeds. If the rollerbeds 30 and 31 are level at the job site, it is simple to easily to push or pull the lift 15 along the rollerbeds out of the back of the truck and up to the rack 18. In order to facilitate the leveling of the rollerbeds, rollerbed sections 35 and 36 are supported on three relative short actuators such as electric actuators 164, 166 and 168 and a central spring support including a support block 170 and a spring 172. Also, rollerbed sections 35 and 36 are connected by three cross members or plates 174, 176 and 178 which keep the rollerbeds 30 and 31 parallel to one another and at the desired spacing relative to one another to accomodate a particular lift. An additional cross members or plates 180 and 182 may be added between the extending roller sections 32 and 33 to strengthen the roller sections and provide the proper spacing therebetween.

A level 184 is attached to the upper end of a vertical member 186 so that the vehicle operator can use the two level bubbles in the right angle level 184 to selectively extend or retract eachs of the actuators 164, 166 and 168 to level the rollerbeds 30 and 31 front to back as well as right to left. Also, a right angle level 188 on the step plate 136 of lift 15 is used to check the level of the rollerbeds 30 and 31 and lift 15. Although it is not required, truck 16 may include a plurality of stanchions or supports 190 to further facilitate the leveling of the rollerbeds 30 and 31 and to support the truck bed and keep the truck from tipping during use of the lift 15. Steps 192 may be added to each of the rollerbeds 30 and 31 to facilitate the climbing of the operator up into the cage 12 once the lift 15 is located in its operative position against the rack 18.

The mobile hoist system and method of the present invention as shown in the embodiment of FIGS. 1–7 of the drawings is designed to be easily deployable by a single operator who drives the trucks 16 to a job site, lowers extending rollerbeds 32 and 33 to the horizontal position shown in FIG. 2 using actuators 160 and 162, leveling the rollerbeds 30 and 31 using actuators 164, 166 and 168, backs the truck up so that the curved ends 156 and 158 of rollerbeds 31 and 32 contact and ride over brace 148 and protrusions 152 and 154 fall down into slots 150 and brace 148. After releasing the tie downs on lift 15, the operator can easily push the lift 15 along the rollerbeds 30 and 31 to about the position shown in FIG. 2. Thereafter, the operator hooks hook 50 on the end of cable 44 into loop 40 on plate 37 and winches or draws the cable in by rotating handle 56 on winch 42. The winch 42 may be fixed to support 43 or may be releasably supported in a winch shoe or channel 194 attached to support 43 and adapted to receive a lower plate on winch 42. The winch handle 56 is rotated until the winch cable 44 is drawn on the winch drum to the point whereat the gearing plate 37 is received within the rack gap 54 and in line with rack 18.

Prior to fully winching the gearing plate 37 into the rack gap 54, engagement arm 80 is moved from its engagement position to allow guide rollers 90 to be moved apart and allow the guide rollers to pass over the gear plate of rack 18. Once the gearing plate 37 is in position in the rack gap 54, engagement arm 80 is moved to its engagement position to secure rollers 90 in the guide channels 98. If necessary, the operator may lower the feed on stanchions of supports 190 and support the truck or truckbed during use of the lift 15. When the work is done at the job site, the operator shuts off power to motor 65, releases engagement arm 80, provides slack in the winch cable 44 sufficient to allow movement of the lift 15 and gearing plate 37 away from the rack 18, unhooks hook 50 from loop 40, pushes the lift 15 back up into the cradle of rollerbed sections 35 and 36, raises roller sections 32 and 33 using actuators 160 and 162, ties down the lift 15 with respect to the truck 16, lifts actuators or stanchions 190, and if winch 42 is portable, removes the winch from the winch shoe 194 and places it in the truck 16. The operator is then free to drive to the next job site and service the sign or the like thereat.

Although the step plate 136 is shown as a relatively small rectangular item attached to platform 10, it is to be understood that the step plate 136 may be enlarged into a wing-shaped work platform adjacent the cage 12, depending on the item being serviced at the top of the pole 20. Also, advertising may be added to the sides 61 and 62 of lift 15 in a position to be viewed during transport of the lift between job sites.

Although the lift 15 is shown with four skids or skid plates 32, it is to be understood that the skid plates may be replaced with rollers, casters, wheels, driven wheels, or the like to facilitate the movement of the lift to and from the rack 18. It is preferred that whatever is used, either skids or wheels to support the lift 15, that they include shock absorbers or springs to absorb the dynamic forces involved when the lift reaches its landing position.

As shown in FIGS. 8–13 of the drawings and in accordance with another embodiment of the present invention, a mobile lift system is generally designated 200 and shown to include a transportable lift 202, an extension arm or boom 204 mounted in the bed of a truck 206, a launching pad 208 supported at the free end of the boom 204. The launghing pad 204 and lift 202 are adapted to be used at a job site including a pole or other vertical support member 210 having attached to one surface thereof a guide plate 212, a drive cable 214, and a safety cable 216.

The lift 202 is similar to the lift 15 of FIGS. 1–7 except that the skid plates 32 of lift 15 have been replaced with spring-cushioned casters, the guide brackets 39 of lift 15 have been replaced with guide blocks 220, and the platform 10 of lift 15 has been replaced with a substantially planar support platform 222 having mounted on the forward end thereof a drive unit 224 and safety unit 226 adapted for use with vertical cables for raising and lowering the lift along the guide plate 212.

Lift 202 includes a cage 230 (like cage 12 of lift 15) having railing 232 on all four sides at least one door 234, a door handle 236, a safety door close switch 238, motor controls 240 inside cage 230, and grab rails 242 and 244 extending upwardly from the top of the guard rails 232.

Also like lift 15, lift 202 includes a generator 246 for driving the electric motor 248 of drive unit 224.

Guide plate 212 is supported by a plurality of pole supports 250 attached to pole 210. Also, near the upper end of guide plate 212 is a small ear 252 and a top stop plate 254. Ear 252 is positioned to trip an upward movement limit switch 256 located on the front of lift 202 between the right and left guide blocks 220. A lower position limit switch 258 is positioned adjacent switch 256 but in position to contact a lower position ear 260 extending from a vertical plate 262 of launching pad 208. Each of the guide blocks 220 include a plurality of front and back rollers and at least one side roller for contacting the front, back and sides of guide plate 212 and launching pad plate 262 and thereby guide and control the movement of lift 202 up and down pole 210 along guide plate 212 and plate 262 of launching pad 208. Like lift 15, lift 202 includes a foot 264 extend downwardly from platform 222 and adapted to contact the front of launching pad plate 262 and guide plate 212.

Launching pad plate 262 is adapted to be received in a plate gap 266 and abut with stop plates 268 and 270 extending from guide rail 212 adjacent plate gap 266.

Like the drive unit 14 of lift 15, drive unit 224 of lift 202 includes a drive motor, preferably an electric motor 248, a gear reducer 272, a drive pinion 274, a follower pinion 276, a free-fall or safety device 278, a drive shaft 280, and a drive spool 282 adapted to receive drive cable 214 thereon. Drive cable 214 extends downwardly from an upper cable support 284 to a drive cable catch 286 which releasably holds the lower end of the drive cable 214 in position to be caught or grabbed by a cable catch 288 on spool 282. Once the drive cable is grabbed by the cable catch 288, the cable is easily pulled from releasable cable holder 286. The holder or cable catch 286 may include a resilient inner member such as a rubber block having a slot cut into the block adapted to releasably receive the cable 214.

Figures 8, 9:
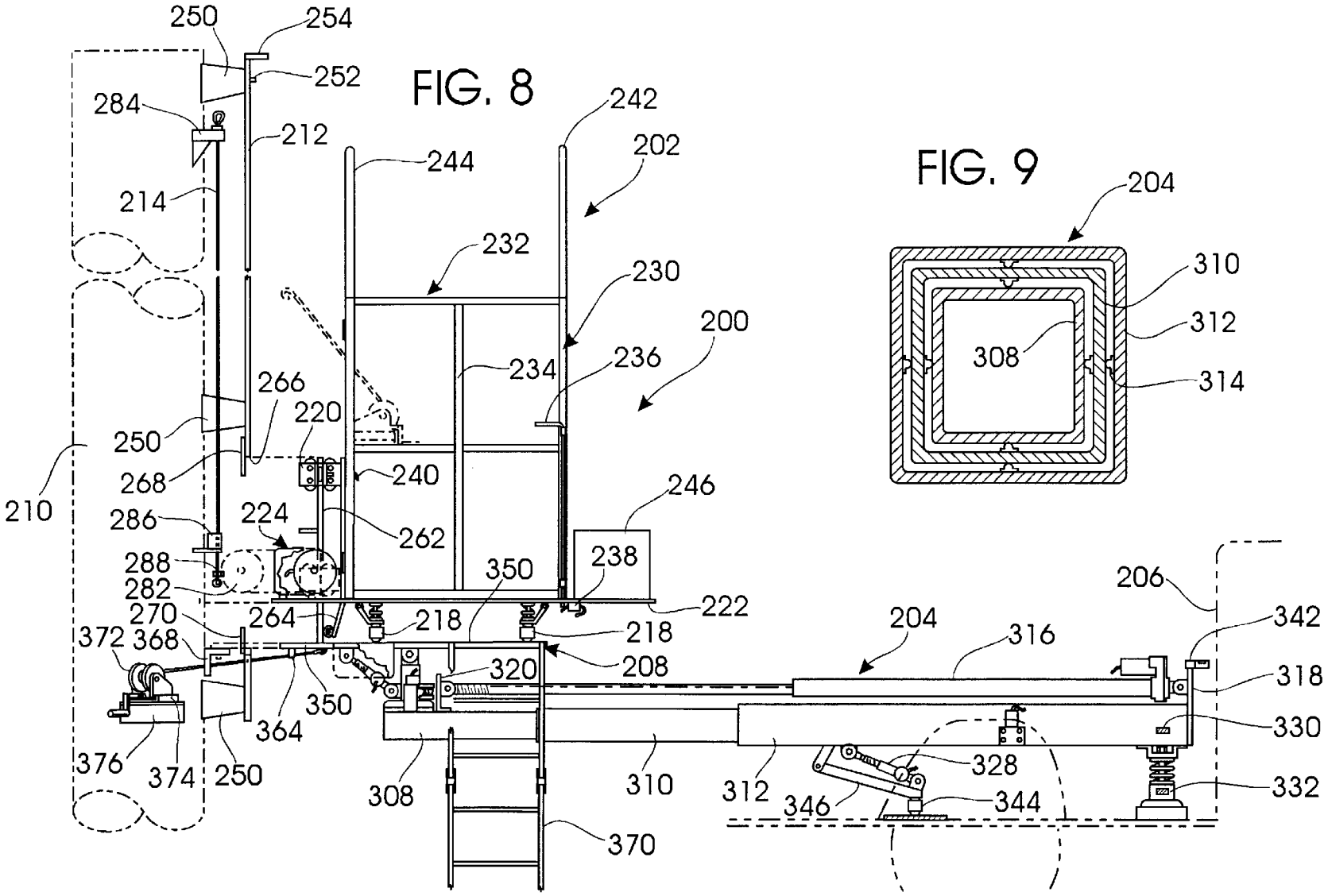
FIG. 8 is a side view illustration of a mobile hoist system in accordance with another embodiment of the present invention.
FIG. 9 is a cross-section illustration of the boom of the mobile hoist system of FIG. 8.
Figure 10:
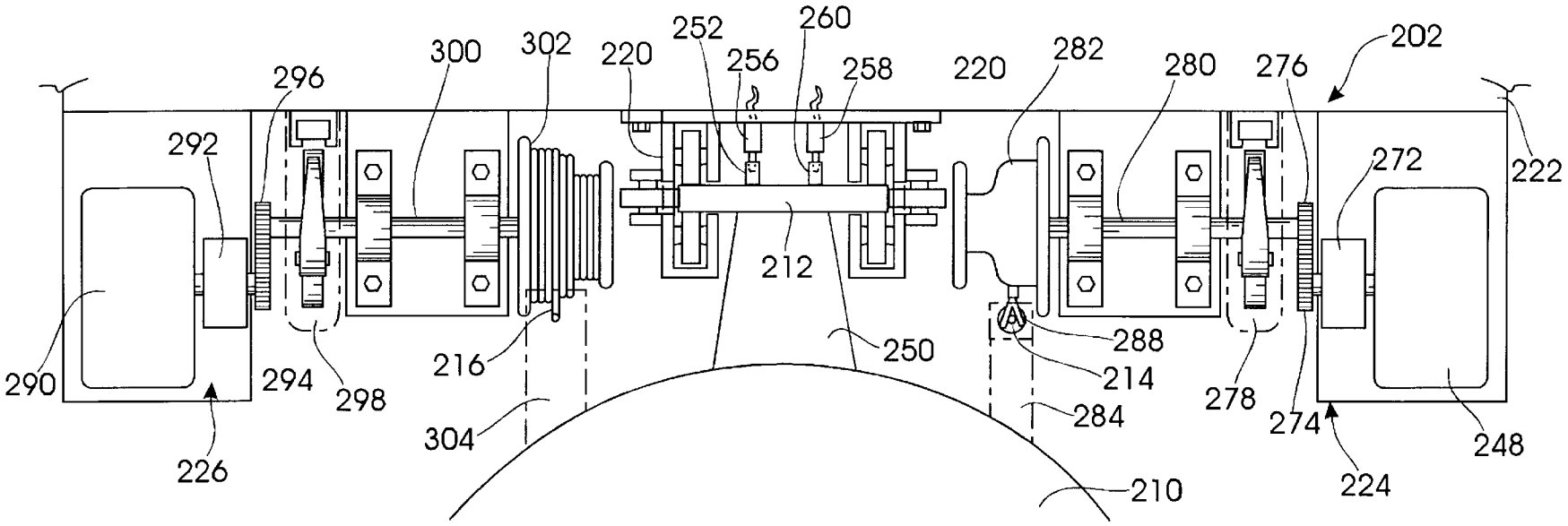
FIG. 10 is an enlarged fragmentary top view representation of the drive arrangement of the lift of FIG. 8.

For the sake of information only, the drive cable spool 282 is shown empty while the safety cable is shown wrapped around the safety cable spool in FIG. 10. It is to be understood that in the position shown in FIG. 8 of the drawings, both the drive and safety cable spools would be empty and in position catching their respective cables and ready to wrap the cables therearound and to ride up the cables as the lift moves up the pole along guide plate 212. Hence, safety cable unit 226 includes a tensioning device 290, a gear reducer 292, pinion gears 294 and 296, a free-fall preventer 298, a shaft 300, and a safety cable spool 302. Like the drive cable 214, the safety cable 216 is suspended along pole 210 from an upper cable support 304 down to a releasable safety cable holder for releasably holding the safety cable 216 in position to be caught by the safety cable catch attached to safety cable spool 302. The tensioning device 290 of safety cable unit 226 includes a motor a clutch arrangement which merely provides for sufficient drive of safety cable spool 302 to allow the safety cable to be wrapped thereon but not of sufficient force to actually drive the lift 202 up the safety cable 216. The safety cable 216 is provided in case the drive cable 214 should break during operation of the device. Although it is preferred to have a safety cable unit as a backup safety device, other safety devices such as breaking mechanisms or clamping devices could be used in association with guide plate 212 to stop movement of the lift 202 should a break occur in drive cable 214.

Figure 11:
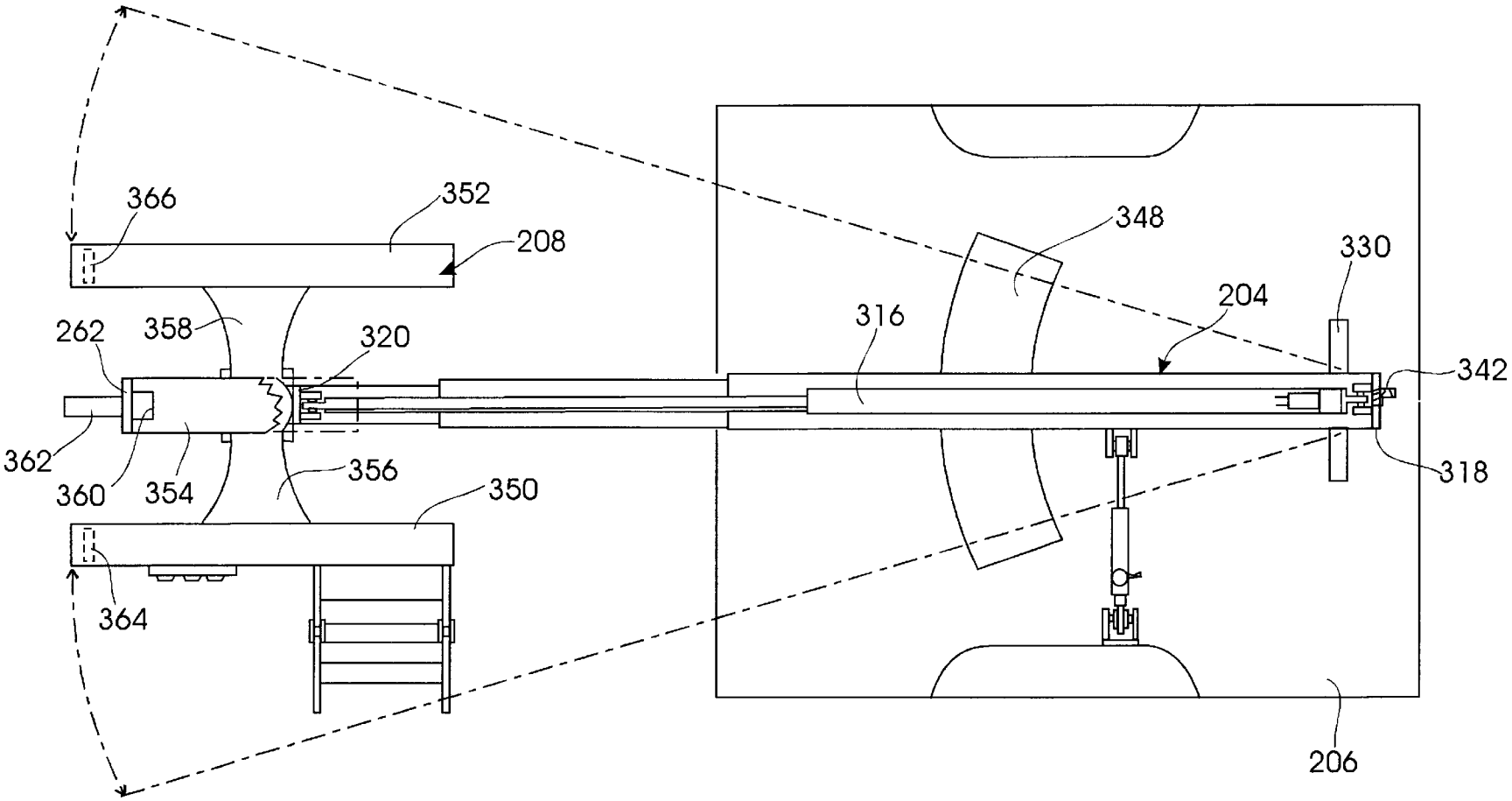
FIG. 11 is a top view illustration of the system of FIG. 8 with the lift removed.
Figure 13:
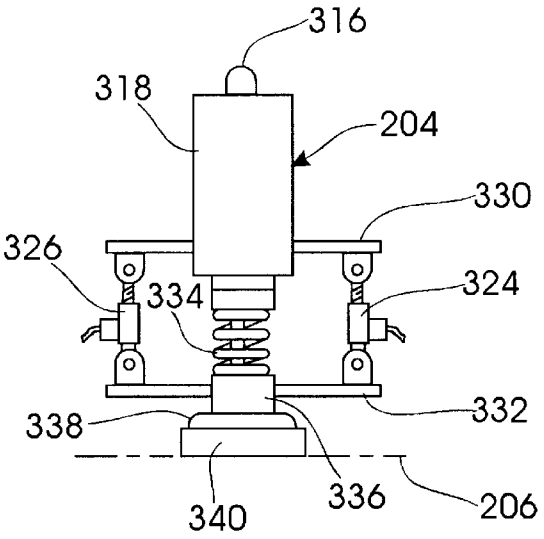
FIG. 13 is an end view illustration of the extending arm or boom of the system of FIGS. 8 and 11.

With reference to FIGS. 8, 9, 11, 12, and 13 of the drawings, lift 202 of system 200 is deployed at the job site via an extendable arm or boom 204 which is shown fully extended in FIG. 11 and partially extended in FIG. 8. With reference to FIG. 9 of the drawings, extendable boom 204 includes three respective telescopically received square steel support members 308, 310 and 312 which slide relative one to the other on bushings or bearings 314 under the force of an elongate electrical actuator 316 having one end attached to a vertical plate 318 mounted on boom member 312 and the other end of actuator 316 attached to a plate 320 extending upwardly from boom member 308. During transport of the lift to and from the job site, the extendable arm 204 is fully retracted to move the launching pad 208 and lift as far as possible up into the bed of the truck 206. At the job site, the operator backs the truck up close to the pole 210 and then extends the boom 204 to move the launching pad 208 up to the pole and in position whereat the launching pad plate 262 is placed inside the guide plate cavity 266 and in line with the guide plate 212. In order to level the lift 202 and launching pad 208 at the job site (adjacent the pole 210) the boom member 312 is mounted on a plurality of actuators 324, 326 and 328 in a similar fashion to the floating mounting of the cradle of roller sections 35 and 36 of system 5. Actuators 324 and 326 extend between upper and lower plates 330 and 332 and can be used to raise or tilt the end of boom member 312 and boom 204. Further, the end of boom member 312 is pivotally supported by a spring 334 mounted atop a shaft 336 the lower end of which is received in a bearing member 338 supported in a base 340. The cylindrical shaft 336 can tilt in any direction.

A right angle level 342 is attached to the top of plate 318 to facilitate the leveling of the boom 204. Forward actuator 328 is located between boom member 312 in a universal direction caster 344 attached to the base of a linkage assembly 346 and adapted to move on an arcuate caster support plate. The actuator 328 is used to raise and lower the free end of the boom 204 and thus raise and lower launching pad 208 with respect to pole 210. Launching pad 208 includes three horizontal members 350, 352 and 354, cross-supports 356 and 358 attaching the horizontal members one to the other. Vertical plate 262 is attached to the forward end of member 354. Member 354 includes an opening 360 adapted to receive foot 264. A bumper 362 is attached to the forward end of member 354 to contact pole 210.

Each of members 350 and 352 have protrusions 364 and 366 extending downwardly therefrom to be received in corresponding slots in a brace 368 attached to pole 210. A ladder 370 extends downwardly from member 350.

Like system 5, system 200 includes a winch 372 received in a winch receiving shoe 374 attached to a support member 376 itself attached to pole 210.

Figure 12:
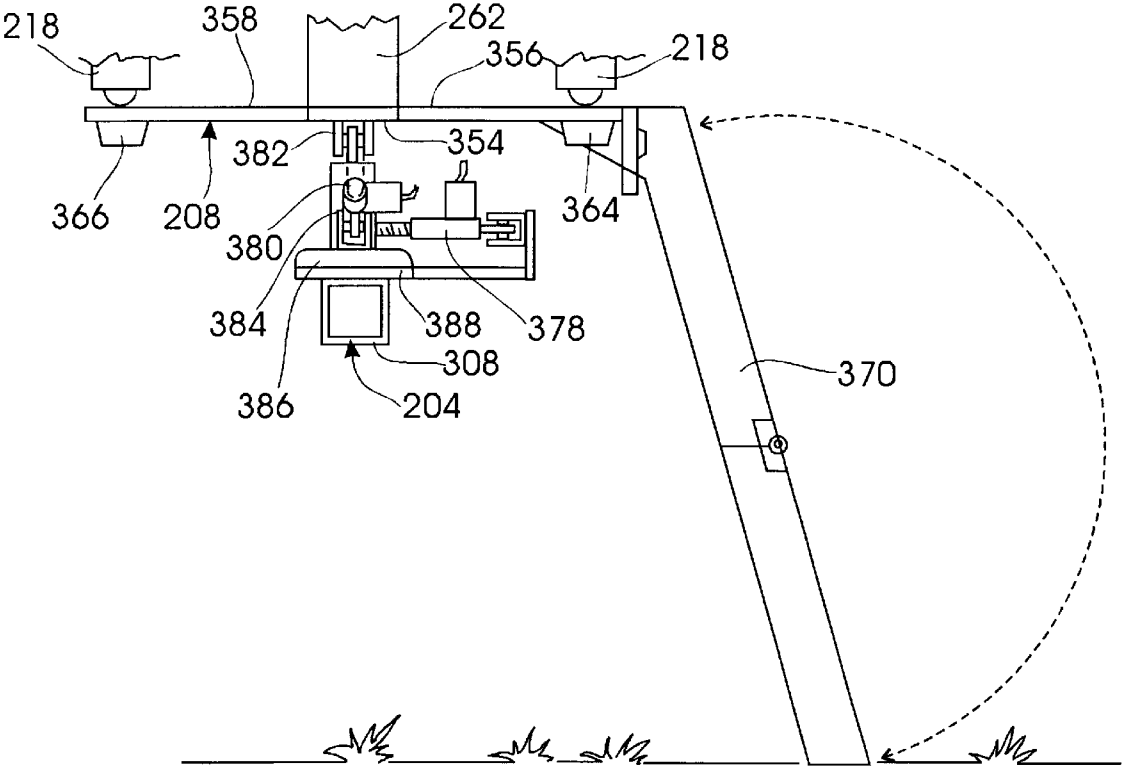
FIG. 12 is an end view illustration of the launching pad of FIGS. 8 and 11.

With reference to FIG. 12 of the drawings, the launching pad 208 is able to pivot about a vertical axis and also pivot about a horizontal axis under the influence of a first actuator 378 and a second actuator 380. Member 354 of launching pad 208 has a downwardly projecting bracket 382 attached to the upper end of a cylindrical shaft 384 received in as bearing 386 atop a plate 388 attached to boom member 308. First actuator 378 is attached between a support member 390 extending from plate 388 and a member extending from shaft 384 to cause rotation of the launching pad about a vertical axis. Actuator 380 has one end attached to member 362 and is used to tilt the launching pad as desired.

Thus, it will be appreciated that as a result of the present invention, a highly effective improved mobile hoist system and method is provided by which the principal objective, among others, is completely fulfilled. It is contemplated, and will be apparent to those skilled in the art from the preceding description and accompanying drawings, that modifications and/or changes may be made in the illustrated embodiments without departure from the present invention. Accordingly, it is expressly intended that the foregoing description and accompanying drawings are illustrative of preferred embodiments only and not limiting, and that the true spirit and scope of the present invention be determined by reference to the appended claims.

I claim:

1. A mobile hoist system for transporting people and supplies up and down a pole or vertical support member for regular maintenance, advertisement updating or changing, servicing, or the like billboards, highway road signs, marquees, signboards, displays, ad signs, and the like which require regular maintenance, advertising updating or changing, servicing, replacing of letters or advertising, servicing lights, changing advertising by painting, papering, or vinyling, or otherwise maintaining the billboard or sign, comprising:

a transportable or mobile lift, elevator, cage, hoist, platform, or carriage which is transported to and from the job site or sign and which is adapted to ascend and descend the pole or vertical support member and including a support platform, a cage or fence, a drive unit, and guiding elements, and a vertical guide plate for facilitating the substantially vertical movement of the transportable or mobile lift up and down the pole or vertical support member, wherein said vertical guide plate has a gap therein adapted to receive a corresponding removable guide plate section which is transported with said transportable or mobile lift and facilitates the proper placement of the transportable lift adjacent the pole and with the removable guide plate section inserted into the gap in the vertical guide plate means.

2. A method of maintaining, advertisement updating or changing, or servicing a sign, marquee, signboard, display, billboard, ad sign, highway or roadside sign, or the like using the mobile hoist system of claim 1 including the steps of:

transporting the transportable lift to the job site or pole;

placing the transportable lift adjacent the pole with the guide plate section located within the gap in said guide plate, and said guiding elements in position to move along said guide plate;

placing one or more persons, supplies, tools, paint, and the like on said platform in said cage of said transportable lift;

activating said drive unit of said transportable lift to cause said transportable lift to ascend the pole or vertical support member along said guide plate means;

stopping said activation of said drive unit when said transportable lift is adjacent said sign or service platform;

maintaining, updating, changing, or servicing said sign or billboard, or the like;

placing the one or more persons, supplies, tools, paint, and the like back on the platform within said cage of said transportable lift;

activating said drive unit to cause said transportable to descend said pole or vertical support member along said guide plate means;

deactivating said drive unit when said transportable lift is adjacent said removable guide plate section;

moving said transportable lift away from said pole or vertical support member along with said removable guide plate section; and, transporting said transportable lift to the next job site.

3. The mobile hoist system as recited in claim 1 wherein said vertical guide plate includes a gear rack, wherein said removable guide plate section includes a section of said gear rack, and wherein said drive unit of said transportable lift includes a drive motor and a drive gear having teeth which mate with the gear rack.

4. The mobile hoist system as recited in claim 1 wherein said vertical guide plate includes at least one elongate cable adapted to be attached to a cable receiving element associated with said drive unit of said transportable lift.

5. The mobile hoist system as recited in claim 1 wherein said transportable lift includes free-fall prevention device which upon free-fall is activated to prevent further free-fall or undesired descent of said transportable lift along said guide plate means.

6. The mobile hoist system as recited in claim 5 wherein said free-fall prevention device includes at least one strike pawl which swings outwardly from a rotating disc under centrifugal force to lock with a catch and prevent rotation of the drive means of said drive unit.

7. The mobile hoist system as recited in claim 1 wherein said system further includes a locking lever on said platform which is moved to a safety locking position prior to movement of the transportable lift up and down on said guide plate.

8. The mobile hoist system as recited in claim 1 further comprising selectively engageable locking means for locking said removable guide plate section in position within the gap in said guide plate when said transportable lift is positioned adjacent the pole or vertical support member and in position to move up and down said guide plate.

9. The mobile hoist system as recited in claim 8 wherein said removable guide plate section locking means includes a winch at least temporarily attached to said pole or vertical support member, a winch cable, and a winch hook attached to the end of the winch cable and adapted to be releasably attached to a ring, eye or loop extending from a back or lower surface of said removable guide plate section.

10. The mobile hoist system as recited in claim 1 further comprising an extendable or telescoping arm or boom adapted to be attached to the bed or back of a pickup truck or flatbed truck in a manner allowing for articulation of the arm or boom for levelling of the transportable lift when the transportable lift is supported on a launch pad or lift support member attached to the free end of the boom or arm.

11. The mobile hoist system as recited in claim 1 wherein said transportable lift is self-contained and self-propelled and wherein said drive unit includes a drive motor, a gear reducer, and a drive gear, which is activated by controls on said transportable lift to move said transportable lift up and down said vertical guide plate.

12. The mobile hoist system as recited in claim 11 wherein said motor is an electric motor and wherein said drive means includes a battery for providing electric power to said electric motor.

13. The mobile hoist system as recited in claim 11 wherein said motor is an internal combustion engine and includes a fuel tank for receiving gasoline, diesel, or the like.

14. The mobile hoist system as recited in claim 11 wherein said motor is an hydraulic motor which receives hydraulic fluid under pressure from an hydraulic pump powered by at least one of an electric motor or internal combustion engine.

15. The mobile hoist system as recited in claim 1 wherein said transportable lift includes a soft landing suspension system for protection of workers and said drive unit.

16. The mobile hoist system as recited in claim 1 wherein said guide plate includes a gear rack having upper and lower ends which are free of gear teeth and which provide a safety space both at the top and bottom limits of the rack to prevent over-travel of the transportable lift along said guide plate.

17. A mobile hoist system for transporting people and supplies up and down a pole or vertical support member for regular maintenance, advertisement updating or changing, servicing, or the like billboards, highway road signs, marquees, signboards, displays, ad signs, and the like which require regular maintenance, advertising updating or changing, servicing, replacing of letters or advertising, servicing lights, changing advertising by painting, papering, or vinyling, or otherwise maintaining the billboard or sign, comprising:

a transportable lift including a support platform, a cage, a drive unit, and guiding elements, and vertical guide plate means for facilitating the substantially vertical movement of the transportable lift up and down the pole or vertical member, wherein said guide plate means has a gap therein adapted to receive a guide plate section which is transported with said transportable lift.

18. A method of maintaining, advertisement updating or changing, or servicing a sign, marquee, signboard, display, billboard, ad sign, highway or roadside sign, or the like using the mobile hoist system of claim 17 including the steps of:

transporting the transportable lift to the job site or pole;

placing the transportable lift adjacent the pole with the guide plate section located within the gap in said guide plate means, and said guiding elements in position to move along said guide plate means;

placing one or more persons, supplies, tools, paint, and the like on said platform in said cage of said transportable lift;

activating said drive unit of said transportable lift to cause said transportable lift to ascend the pole or vertical support member along said guide plate means;

stopping said activation of said drive unit when said transportable lift is adjacent said sign or service platform;

maintaining, updating, changing, or servicing said sign or billboard, or the like;

placing the one or more persons, supplies, tools, paint, and the like back on the platform within said cage of said transportable lift;

activating said drive unit to cause said transportable unit to descend said pole or vertical support member along said guide plate means;

deactivating said drive unit when said transportable lift is adjacent said removable guide plate section;

moving said transportable lift away from said pole or vertical support member along with said removable guide plate section; and, transporting said transportable lift to the next job site.

19. The mobile hoist system as recited in claim 17 wherein said guide plate means includes a gear rack, wherein said removable guide plate section includes a section of said gear rack, and wherein said drive unit of said transportable lift includes a drive motor and a gear having teeth which mate with the gear rack.

20. The mobile hoist system as recited in claim 17 wherein said guide plate means includes at least one elongate cable adapted to be attached to a cable receiving element associated with said drive unit of said transportable lift.

21. A vertical guide plate for facilitating the substantially vertical movement of a transportable lift up and down a pole or vertical support member of a billboard or sign, and having a gap therein adjacent the lower end of said vertical guide plate for receiving a corresponding removable guide plate section which is transported with a transportable lift of a mobile hoist system for transporting people and supplies up and down a pole or vertical support member for regular maintenance, advertisement updating or changing, servicing, or the like billboards, highway road signs, marquees, signboards, displays, ad signs, and the like which require regular maintenance, advertising updating or changing, servicing, replacing of letters or advertising, servicing lights, changing advertising by painting, papering, or vinyling, or otherwise maintaining the billboard or sign.

* * * * *